US006820687B2

(12) United States Patent
Maguire et al.

(10) Patent No.: US 6,820,687 B2
(45) Date of Patent: Nov. 23, 2004

(54) AUTO REVERSING EXPANDING ROLLER SYSTEM

(75) Inventors: Patrick G. Maguire, Cypress, TX (US); Khai Tran, Pearland, TX (US); Alexander Craig Mackay, Aberdeen (GB); Mark Murray, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 29 days.

(21) Appl. No.: 10/234,058

(22) Filed: Sep. 3, 2002

(65) Prior Publication Data

US 2004/0040721 A1 Mar. 4, 2004

(51) Int. Cl.[7] ..... E21B 19/16
(52) U.S. Cl. ..... 166/207; 166/380
(58) Field of Search ..... 166/380, 383, 166/384, 285, 291, 207, 177.4, 381

(56) References Cited

U.S. PATENT DOCUMENTS

| | | | |
|---|---|---|---|
| 761,518 A | 5/1904 | Lykken | |
| 1,324,303 A | 12/1919 | Carmichael | |

(List continued on next page.)

FOREIGN PATENT DOCUMENTS

| | | | |
|---|---|---|---|
| EP | 0 961 007 A2 | 12/1999 | ..... E21B/33/10 |
| GB | 2 320 734 A | 7/1998 | ..... E21B/33/127 |
| GB | 2 345 308 A | 7/2000 | ..... E21B/43/10 |
| WO | WO 93/24728 | 12/1993 | ..... E21B/17/10 |
| WO | WO 99/18328 | 4/1999 | ..... E21B/23/01 |
| WO | WO 99/23354 | 5/1999 | ..... E21B/43/10 |
| WO | WO 00/37766 | 6/2000 | ..... E21B/29/00 |
| WO | WO 00/37767 | 6/2000 | ..... E21B/29/00 |
| WO | WO 00/37768 | 6/2000 | ..... E21B/29/10 |
| WO | WO 00/37772 | 6/2000 | ..... E21B/43/10 |
| WO | WO 00/37773 | 6/2000 | ..... E21B/43/10 |
| WO | WO 01/60545 A1 | 8/2001 | ..... B21D/39/00 |

OTHER PUBLICATIONS

UK Search Report, U.K. Application No. GB 0320644.8, dated Nov. 11, 2003.

(List continued on next page.)

*Primary Examiner*—Frank Tsay
(74) *Attorney, Agent, or Firm*—Moser, Patterson & Sheridan, L.L.P.

(57) ABSTRACT

The present invention provides an apparatus and method expanding a portion of a tubular. The expansion apparatus is run into a wellbore on a working string. The expansion apparatus first comprises a rotary expander for expanding an expandable tubular. The expansion apparatus further comprises a spline assembly for coupling the rotary expander to a motor disposed on the work string. The rotary expander and spline assembly have hollow bodies that allow them to encircle the work string and rotate relative thereto. The spline assembly comprises an inner sleeve and outer sleeve. The inner sleeve is attached to the motor and the outer sleeve is attached to the rotary expander. The inner and outer sleeves are coupled to each other using a spline and groove connection. The connection allows the rotary expander to be rotated by the motor, while at the same time, allow the rotary expander to move axially relative to the motor. The rotary expander comprises two rows of rollers for expansion against the tubular. The position of the rollers on the first row is skewed in one direction relative to the longitudinal axis. The rollers on the second row are skewed in an opposite direction. When actuated, the skew angle of the rollers will cause the expander tool to move axially. Because the rollers of the two rows are placed at opposing skew angles, alternating actuation between the two rows of rollers causes the expander to move in opposite axial directions during expansion.

59 Claims, 10 Drawing Sheets

U.S. PATENT DOCUMENTS

| | | | | |
|---|---|---|---|---|
| 1,545,039 | A | | 7/1925 | Deavers |
| 1,561,418 | A | | 11/1925 | Duda |
| 1,569,729 | A | | 1/1926 | Duda |
| 1,597,212 | A | | 8/1926 | Spengler |
| 1,930,825 | A | | 10/1933 | Raymond ..... 153/81 |
| 2,383,214 | A | | 8/1945 | Prout ..... 153/82 |
| 2,499,630 | A | | 3/1950 | Clark ..... 153/81 |
| 2,627,891 | A | | 2/1953 | Clark ..... 153/82 |
| 2,663,073 | A | | 12/1953 | Bieber et al. ..... 29/148 |
| 2,898,971 | A | | 8/1959 | Hempel ..... 153/82 |
| 3,087,546 | A | | 4/1963 | Woolley ..... 166/46 |
| 3,186,485 | A | | 6/1965 | Owen ..... 166/63 |
| 3,191,677 | A | | 6/1965 | Kinley ..... 166/14 |
| 3,195,646 | A | | 7/1965 | Brown ..... 166/208 |
| 3,208,531 | A | | 9/1965 | Tamplen ..... 166/125 |
| 3,412,565 | A | | 11/1968 | Lindsey et al. ..... 61/53.5 |
| 3,467,180 | A | | 9/1969 | Pensotti ..... 165/180 |
| 3,498,376 | A | | 3/1970 | Sizer et al. ..... 166/120 |
| 3,669,190 | A | | 6/1972 | Sizer et al. ..... 166/315 |
| 3,712,376 | A | | 1/1973 | Owen et al. ..... 166/277 |
| 3,746,091 | A | | 7/1973 | Owen et al. ..... 166/207 |
| 3,776,307 | A | | 12/1973 | Young ..... 166/125 |
| 3,818,734 | A | | 6/1974 | Bateman ..... 72/75 |
| 3,911,707 | A | | 10/1975 | Minakov et al. ..... 72/76 |
| 3,948,321 | A | | 4/1976 | Owen et al. ..... 166/277 |
| 4,069,573 | A | | 1/1978 | Rogers, Jr. et al. ..... 29/421 R |
| 4,127,168 | A | | 11/1978 | Hanson et al. ..... 166/123 |
| 4,159,564 | A | | 7/1979 | Cooper, Jr. ..... 20/727 |
| 4,288,082 | A | | 9/1981 | Setterberg, Jr. ..... 277/125 |
| 4,324,407 | A | | 4/1982 | Upham et al. ..... 277/27 |
| 4,327,567 | A | * | 5/1982 | Martin ..... 72/119 |
| 4,429,620 | A | | 2/1984 | Burkhardt et al. ..... 91/395 |
| 4,531,581 | A | | 7/1985 | Pringle et al. ..... 166/120 |
| 4,588,030 | A | | 5/1986 | Blizzard ..... 166/120 |
| 4,697,640 | A | | 10/1987 | Szarka ..... 166/120 |
| 4,848,469 | A | | 7/1989 | Baugh et al. ..... 166/382 |
| 5,271,472 | A | | 12/1993 | Leturno ..... 175/107 |
| 5,398,754 | A | | 3/1995 | Dinhoble ..... 166/117.6 |
| 5,409,059 | A | | 4/1995 | McHardy ..... 166/208 |
| 5,409,060 | A | | 4/1995 | Carter ..... 166/237 |
| 5,435,400 | A | | 7/1995 | Smith ..... 175/61 |
| 5,472,057 | A | | 12/1995 | Winfree ..... 175/57 |
| 5,533,573 | A | | 7/1996 | Jordan, Jr. et al. ..... 166/313 |
| 5,560,426 | A | | 10/1996 | Trahan et al. ..... 166/120 |
| 5,685,369 | A | | 11/1997 | Ellis et al. ..... 166/195 |
| 5,901,787 | A | | 5/1999 | Boyle ..... 166/135 |
| 6,012,516 | A | | 1/2000 | Brunet ..... 166/50 |
| 6,021,850 | A | | 2/2000 | Wood et al. ..... 166/280 |
| 6,098,717 | A | | 8/2000 | Bailey et al. ..... 166/382 |
| 6,186,233 | B1 | | 2/2001 | Brunet ..... 166/298 |
| 6,325,148 | B1 | | 12/2001 | Trahan et al. ..... 166/297 |
| 6,425,444 | B1 | | 7/2002 | Metcalfe et al. ..... 166/387 |
| 6,446,323 | B1 | | 9/2002 | Metcalfe et al. ..... 29/523 |
| 6,457,532 | B1 | | 10/2002 | Simpson ..... 166/380 |
| 6,488,095 | B2 | | 12/2002 | Buytaert ..... 166/382 |
| 2001/0020532 | A1 | | 9/2001 | Baugh et al. ..... 166/285 |
| 2002/0145281 | A1 | | 10/2002 | Metcalfe et al. ..... 285/206 |
| 2002/0166668 | A1 | | 11/2002 | Metcalfe et al. ..... 166/378 |
| 2003/0121655 | A1 | | 7/2003 | Lauritzen et al. ..... 166/207 |

OTHER PUBLICATIONS

U.S. patent application Ser. No. 10/349,432, Tran et al., filed Jan. 22, 2003.

U.S. patent application Ser. No. 10/034,592, Lauritzen et al., filed Dec. 28, 2001.

U.S. patent application Ser. No. 10/267,025, Tran et al., filed Oct. 8, 2002.

U.S. patent application Ser. No. 10/253,114, Maguire, filed Sep. 24, 2002.

U.S. patent application Publication, Baugh, et al., Pub. No.: US 2001/0020532 A1, Pub. Date: Sep. 13, 2001, "Hanging Liners By Pipe Expansion," Filed May 3, 2001.

U.S. patent application Ser. No. 09/470,154, Metcalfe et al., filed Dec. 22, 1999.

U.S. patent application Ser. No. 09/469,690, Simpson, filed Dec. 22, 1999.

U.S. patent application Ser. No. 09/469,681, Metcalfe et al., filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

* cited by examiner

AUTO REVERSING EXPANDING ROLLER SYSTEM

BACKGROUND OF THE INVENTION

1. Field of the Invention

The present invention relates to methods for wellbore completion. More particularly, the invention relates to completing a wellbore by expanding tubulars therein. More particularly still, the invention relates to an auto reversing expander apparatus for expanding a section of a tubular.

2. Description of the Related Art

Hydrocarbon and other wells are completed by forming a borehole in the earth and then lining the borehole with steel pipe or casing to form a wellbore. After a section of wellbore is formed by drilling, a section of casing is lowered into the wellbore and temporarily hung therein from the surface of the well. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever decreasing diameter.

Apparatus and methods are emerging that permit tubulars to be expanded in situ. The apparatus typically includes expander tools which are fluid powered and are run into the wellbore on a working string. The hydraulic expander tools include radially expandable members which, through fluid pressure, are urged outward radially from the body of the expander tool and into contact with a tubular therearound. As sufficient pressure is generated on a piston surface behind these expansion members, the tubular being acted upon by the expansion tool is expanded past its point of plastic deformation. In this manner, the inner and outer diameter of the tubular is increased in the wellbore. By rotating the expander tool in the wellbore and/or moving the expander tool axially in the wellbore with the expansion member actuated, a tubular can be expanded along a predetermined length in a wellbore.

Multiple uses for expandable tubulars are being discovered. For example, an intermediate string of casing can be hung off of a string of surface casing by expanding a portion of the intermediate string into frictional contact with the lower portion of surface casing therearound. This allows for the hanging of a string of casing without the need for a separate slip assembly as described above. Additional applications for the expansion of downhole tubulars exist. These include the use of an expandable sand screen, employment of an expandable seat for seating a diverter tool, and the use of an expandable seat for setting a packer.

There are problems associated with the expansion of tubulars. One problem particularly associated with the use of rotatary expander tools is the likelihood of obtaining an uneven expansion of a tubular. In this respect, the inner diameter of the tubular that is expanded tends to initially assume the shape of the compliant rollers of the expander tool, including imperfections in the rollers. Moreover, as the working string is rotated from the surface, the expander tool may temporarily stick during expansion of a tubular, then turn quickly, and then stop again. This spring action in the working string creates imperfections in the expansion job.

Another obstacle to smooth expansion relates to the phenomenon of pipe stretch. Those of ordinary skill in the art will understand that raising a working string a selected distance at the surface does not necessarily result in the raising of a tool at the lower end of a working string by that same selected distance. The potential for pipe stretch is great during the process of expanding a tubular. Once the expander tool is actuated at a selected depth, an expanded profile is created within the expanded tubular. This profile creates an immediate obstacle to the raising or lowering of the expander tool. Merely raising the working string a few feet from the surface will not, in many instances, result in the raising of the expander tool; rather, it will only result in stretching of the working string. Applying further tensile force in order to unstick the expander tool may cause a sudden recoil, causing the expander tool to move uphole too quickly, leaving gaps in the tubular to be expanded. The same problem exists in the context of pipe compression when the working string attempts to lower the expander tool.

The overall result of the sticking problems described above is that the inner diameter of the expanded tubular is not perfectly round and no longer has a uniform inner circumference.

There is a need, therefore, for an improved apparatus for expanding a portion of casing or other tubular within a wellbore. Further, there is a need for an apparatus which will aid in the expansion of a tubular downhole and which avoids the potential of pipe-stretch/pipe-compression by the working string. Still further, a need exists for an apparatus which will selectively translate a completion tool such as a rotary expander axially downhole without requiring that the working string be raised or lowered.

There is yet a further need for a method for expanding a tubular which avoids the risk of uneven expansion of the tubular caused by pipe-stretch incident to raising or lowering the working string.

SUMMARY OF THE INVENTION

The present invention provides an apparatus and method for expanding a portion of a tubular. The expansion apparatus is run into a wellbore on a working string. The expansion apparatus comprises a rotary expander for expanding a lower string of casing or other expandable tubular in the wellbore. The expansion apparatus further comprises a spline assembly for coupling the rotary expander to a motor disposed on the work string, thereby allowing the rotary expander to be rotated by the motor. The rotary expander and spline assembly have hollow bodies that allow them to encircle the work string and rotate relative thereto. The spline assembly comprises an inner sleeve and an outer sleeve slidably coupled to each other by a series of splines and grooves. Preferably, the inner sleeve is attached to the motor and the outer sleeve is attached to the rotary expander. The splines and grooves allow the motor to transmit torque to the rotary expander, and also allow the rotary expander to move axially relative to the motor during rotation. The rotary expander comprises two rows of rollers for expansion against the tubular. The position of the rollers on the first row is skewed in one direction relative to the longitudinal axis. The rollers on the second row are skewed in an opposite direction relative to the longitudinal axis. When the expander tool is rotated and one row of rollers is expanded against the tubular, the skew angle of the actuated rollers causes the expander tool to move axially. Because the rollers of the two rows are placed at opposing skew angles, alternating actuation between the two rows of rollers will cause the expander tool to move in opposite axial directions.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
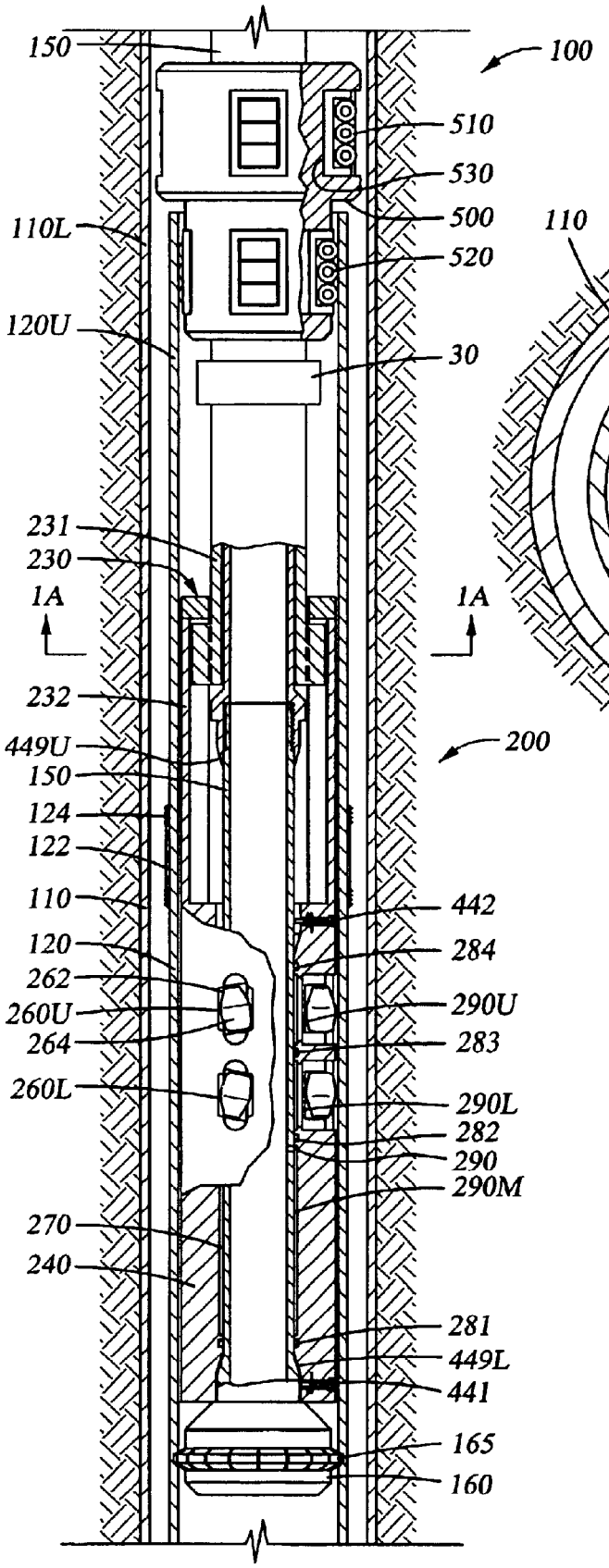
FIG. 1 is a partial sectional view of an expander tool of the present invention disposed in a wellbore having an upper string of casing and a lower string of casing. In this view, the expander tool is at its lower limits of axial movement.

FIG. 1 presents a cross-sectional view of a wellbore 100 having an upper string of casing 110 and a lower string of casing 120. The lower string of casing 120, or liner, is being lowered into the wellbore 100 co-axially with the upper string of casing 110. The lower string of casing 120 is positioned such that an upper portion 120U of the lower string of casing 120 overlaps with a lower portion 110L of the upper string of casing 110.

In the example of FIG. 1, the lower string of casing 120 serves as an expandable tubular. The lower string of casing 120 will be hung off of the upper string of casing 110 by expanding the upper portion 120U of the lower string of casing 110 into the lower portion 110L of the upper string of casing 110. However, it is understood that the apparatus and method of the present invention may be utilized to expand downhole tubulars other than strings of casing.

A sealing member 122 is preferably disposed on the outer surface of the lower string of casing 120. In the preferred embodiment, the sealing member 122 defines a matrix formed in grooves (not shown) on the outer surface of the lower string of casing 120. However, other configurations are permissible, including one or more simple rings formed circumferentially around the lower string of casing 120.

The sealing member 122 is fabricated from a suitable material based upon the service environment that exists within the wellbore 100. Factors to be considered when selecting a suitable sealing member 122 include the chemicals likely to contact the sealing member, the prolonged impact of hydrocarbon contact on the sealing member, the presence and concentration of erosive compounds such as hydrogen sulfide or chlorine, and the pressure and temperature at which the sealing member must operate. In a preferred embodiment, the sealing member 122 is fabricated from an elastomeric material. However, non-elastomeric materials or polymers may be employed as well, so long as they substantially prevent production fluids from passing between the outer surface of the lower string of casing 120U and the inner surface of the upper string of casing 110 after the expandable section 120U of the casing 120 has been expanded.

Also positioned on the outer surface of the lower string of casing 120 is at least one slip member 124. The slip member 124 is used to provide an improved grip between the expandable tubular 120U and the upper string of casing 110 when the lower string of casing 120 is expanded. In this example, the slip member 124 defines a plurality of carbide buttons interspersed within the matrix of the sealing member 122. However, any suitable placement of a hardened material which provides a gripping means for the lower string of casing 120 into the upper string of casing 110 may be used. For example, a simple pair of rings having grip surfaces (not shown) formed thereon for engaging the inner surface of the upper string of casing 110 when the lower string of casing 120 is expanded would be suitable. The size, shape and hardness of the slips 124 are selected depending upon factors well known in the art such as the hardness of the inner wall of casing 110, the weight of the casing string 120 being hung, and the arrangement of slips 124 used.

A working string 150 is also shown in FIG. 1. The working string 150 serves as a run-in string for the expander tool 200 of the present invention. In this regard, the expander tool 200 is preferably run into the wellbore 100 at the lower end of the working string 150.

A collett 160 is shown near the end of the working string 150. The collett 160 is landed into a radial profile 165 within the lower string of casing 120 so as to support the lower string of casing 120. The collett 160 is mechanically or hydraulically actuated as is known in the art, and supports the lower string of casing 120 until such time as the lower string of casing 120 has been expandably set by actuation of the expander tool 200.

A torque anchor 500 may be disposed on the working string 150 to prevent rotation of the lower string of casing 120 during the expansion process. FIG. 1 shows the torque anchor 500 in the run-in position. In this view, the torque anchor 500 is in an unactuated position in order to facilitate run-in of the expander tool 200 and the lower casing string 120. The torque anchor 500 defines a body having sets of wheels 510, 520 radially disposed around its perimeter. The wheels 510, 520 reside within wheel housings 530, and are oriented to permit axial (vertical) movement, but not rotational movement of the torque anchor 500. Sharp edges (not shown) along the wheels 510, 520 aid in inhibiting rotational movement of the torque anchor 500. In the preferred embodiment, four sets of wheels 510 and 520 are employed to act against the upper casing 110 and the lower casing 120 strings, respectively. Although wheels 510, 520 are presented in the FIG. 1, other types of slip mechanisms may be employed with the torque anchor 500 without deviating from the aspects of the present invention.

Figure 2:
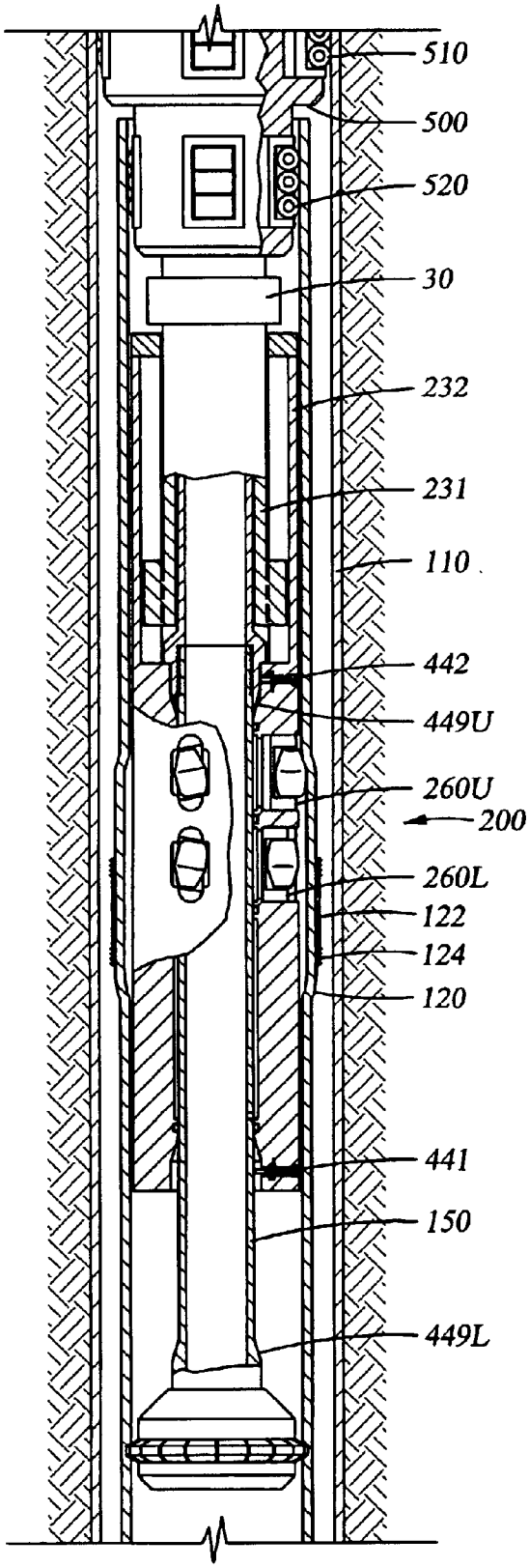
FIG. 2 is a partial sectional view of the expander tool partially translated in the wellbore. In this view, the expander tool is at its upper limits of axial movement.

The torque anchor 500 is run into the wellbore on the working string 150 along with the expander tool 200 and the lower casing string 120. In the run-in position, the wheel housings 530 are maintained essentially within the torque anchor body 500. Once the lower string of casing 120 has been lowered to the appropriate depth within the wellbore, the torque anchor 500 is activated. Fluid pressure provided from the surface through the working string 150 acts against the wheel housings 530 to force the wheels 510 and 520 outward from the torque anchor body 500. Wheels 510 act against the inner surface of the upper casing string 110, while wheels 520 act against the inner surface of the lower casing string 120. This activated position is depicted in FIG. 2. In the activated position, the torque anchor 500 is rotationally fixed relative to the upper string of casing 110.

As shown in FIG. 1, disposed on the working string in the wellbore is an expander tool 200 provided to expand the lower string of casing 120. The expander tool 200 may be coupled to a motor 30 to provide rotational movement to the expander tool 200. The motor 30 is disposed on the work string 150 and may be hydraulically actuated by a fluid medium being pumped through the work string 150 to the motor 30. The motor 30 may be a positive displacement motor or other types of motor known in the art.

A spline assembly 230 may be used to couple the expander tool 200 to the motor 30. The spline assembly 230 has a body which is hollow and generally tubular. The hollow body allows the spline assembly 230 to encircle the work string 150 and rotate relative thereto. The spline assembly 230 includes an inner sleeve 231 at least partially disposed within an outer sleeve 232. Preferably, an axial end of the inner sleeve 231 extending out of the outer sleeve 232 is attached to the motor 30, and an axial end of the outer sleeve 232 not overlapping the inner sleeve 231 is attached to the expander tool 200.

Figure 1A:
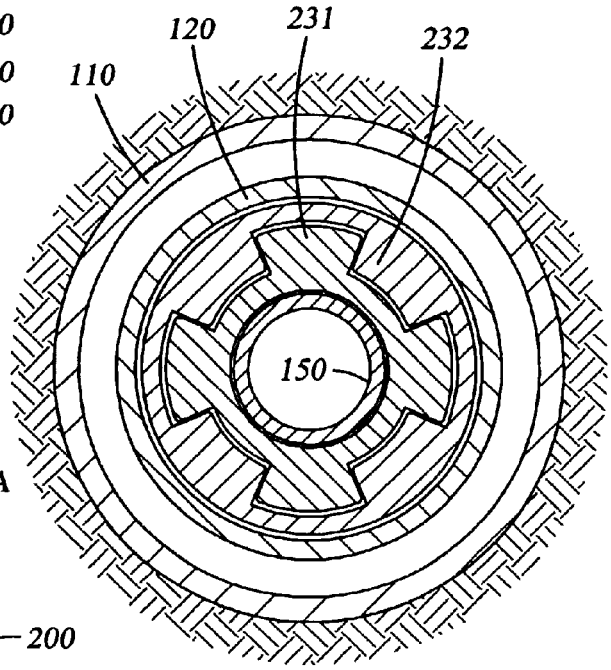
FIG. 1A is a cross-sectional view of the expander tool taken at line 1A—1A of FIG. 1.

Referring to FIG. 1A, the sleeves 231, 232 are slidably coupled to each other using a spline and groove connection. Preferably, splines are formed circumferentially on an outer surface of the inner sleeve 231. The splines mate with the grooves formed circumferentially on an inner surface of the outer sleeve 232. The spline and groove connection allows the inner sleeve 231 to impart rotation to the outer sleeve 232 as the inner sleeve 231 is rotated by the motor 30. The rotation is imparted without restricting the axial movement of the outer sleeve 232 relative to the inner sleeve 231. Therefore, the sleeves 231, 232 may extend or retract relative to each other during rotation. The amount of axial movement is predetermined to control the length of tubular expansion.

The expander tool 200 has a central body 240 which is hollow and generally tubular. The tubular shape of the central body 240 allows the expander tool 200 to encircle the work string 150 and rotate relative thereto. The central body 240 and the work string 150 form an annular space 270 for fluid flow. One or more seals 281–284 are used to prevent fluids from leaking out of the annular space 270. The central body 240 has a plurality of windows 262 to hold a respective roller 264. Each of the windows 262 has parallel sides and holds a roller 264 capable of extending radially from the expander tool 200.

In one aspect of the present invention, two rows 260U, 260L of rollers 264 are disposed on the expander tool 200 as shown in FIG. 1. Each row 260U, 260L may have a plurality of rollers 264 radially disposed at mutual circumferential separations around the expander tool 200. Although only three rollers 264 are shown for each row 260U, 260L, any number of rollers 264 may be used.

Figure 1B:
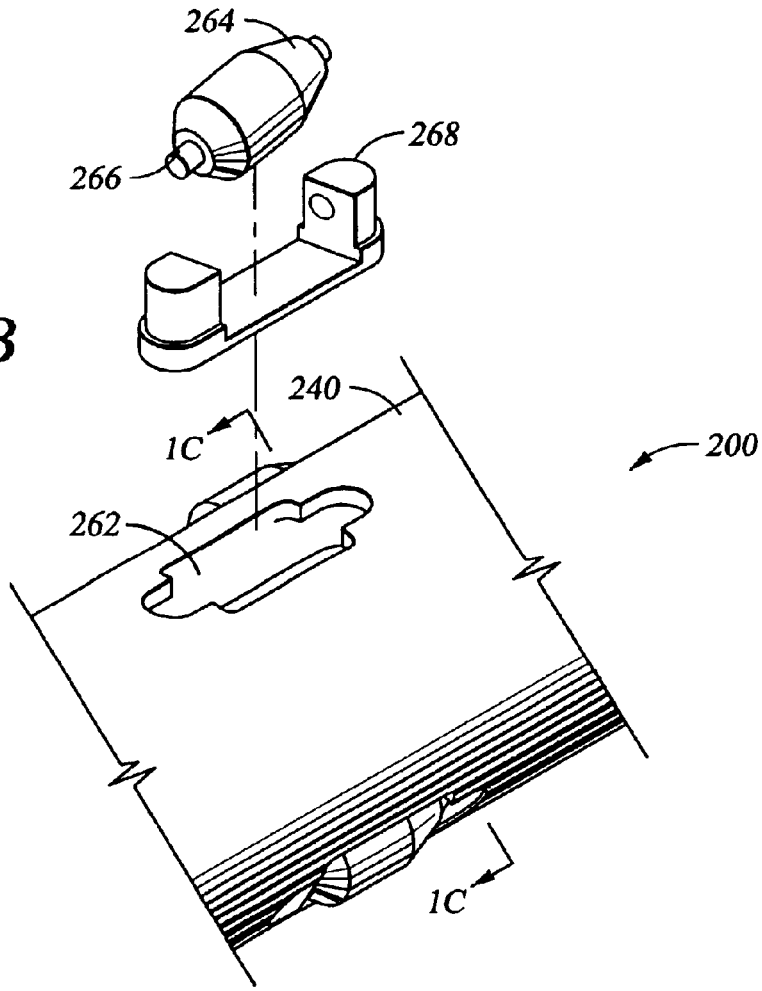
FIG. 1B is a sectional view of the expander tool in FIG. 1.
Figure 1C:
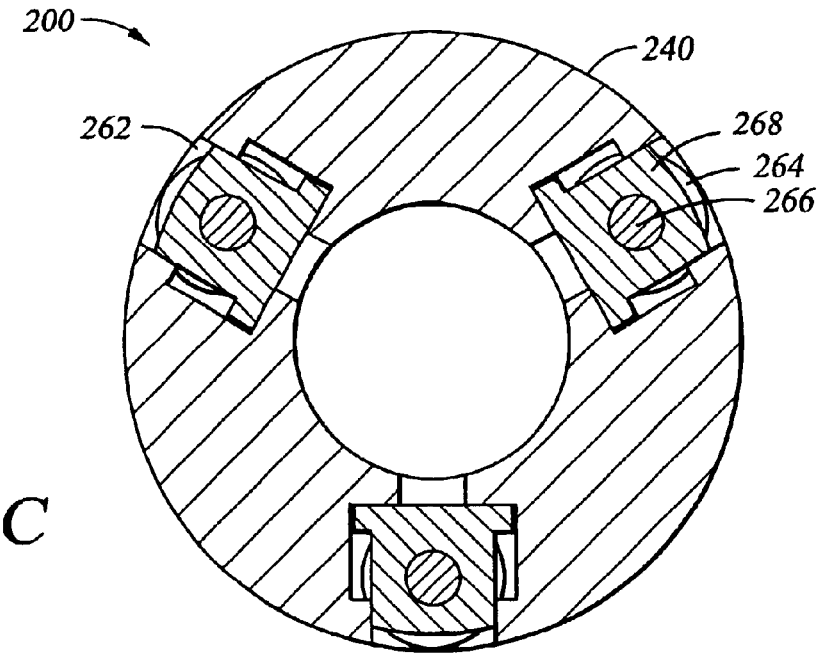
FIG. 1C is a cross-sectional view of the expander tool taken at 1C—1C of FIG. 1B.

FIG. 1B is a sectional view of an exemplary expander tool 200. FIG. 1C presents the same expander tool 200 in cross-section, with the view taken across line 1C—1C of FIG. 1B.

Each of the rollers 264 is supported by a shaft 266 at each end of the respective roller 264 for rotation about a respective rotational axis. Each shaft 266 is formed integral to its corresponding roller 264 and is capable of rotating within a corresponding piston 268. The pistons 268 are radially slidable, each being slidably sealed within its respective radially extended window 262. The back side of each piston 268 is exposed to the pressure of fluid within the annular space 270 between the tool 200 and the work string 150. In this manner, pressurized fluid provided from the surface of the well can actuate the pistons 268 and cause them to extend outwardly whereby the rollers 264 contact the inner surface of the tubular 120U to be expanded.

Generally, the rollers 264 illustrated in FIG. 1B have cylindrical or barrel-shaped cross-sections. However, it is to be appreciated that other roller shapes re possible. For example, a roller 264 may have a cross sectional shape that is conical, truncated conical, semi-spherical, multifaceted, elliptical, or any other cross sectional shape suited to the expansion operation to be conducted within the tubular. Furthermore , other types of expander members, including expander pads, may be used with the expander tool 200 without departing from the aspects of the present invention.

To translate the expander tool 200, the rollers 264 are positioned at a skewed angle with respect to the longitudinal axis as shown in FIG. 1. The position of the rollers 264 in the first row 260U is skewed in one direction relative to the longitudinal axis of the tool 200. Additionally, the position of the rollers 264 in the second row 260L is skewed in an opposite direction of the first row 260U relative to longitudinal axis. It is believed that, when the rollers 264 are rotated against the lower string of casing 120, the skew angle of the rollers 264 will cause the rollers 264 to travel in a spiral along the inner circumference of the lower string 120. The spiral movement effectively moves the expander tool 200 axially as it rotates. Therefore, when the first row 260U of rollers 264 is actuated, the expander tool 200 will move in one axial direction. Thereafter, when the second row 260L is actuated and the first row 260U is de-actuated, the expander tool 200 will move in an opposite axial direction because of the opposing skew angles. Moreover, the skew angle of the rollers 264 determines the rate at which the expander tool 200 moves axially. Thus, if the skew angle is increased, the expander tool 200 will move axially at an increased rate.

Pressurized fluid for actuating the rollers 264 is supplied from the surface through the working string 150 to actuate the rollers 264. The fluid from the working string 150 enters the annular space 270 between the expander tool 200 and the work string 150 through a port 290 formed in the working string 150. Seals 281–284 are used to prevent leakage of the fluid and divide the annular space 270 into different chambers 290U, 290L, 290M for supplying fluid to the rollers 264.

Initially, fluid from the working string 150 flows across the port 290 and enters the main chamber 290M enclosed by seals 281 and 282. The seals 281, 282 are placed such that the main chamber 290M will be in continuous fluid communication with the port 290 as the expander tool 200 moves axially during expansion. Seals 284, 283 are also placed in the annular space 270 to form an upper chamber 290U and a lower chamber 290L for holding fluid used to actuate the first and second row 260U, 260L of rollers 264, respectively.

Figure 6A:
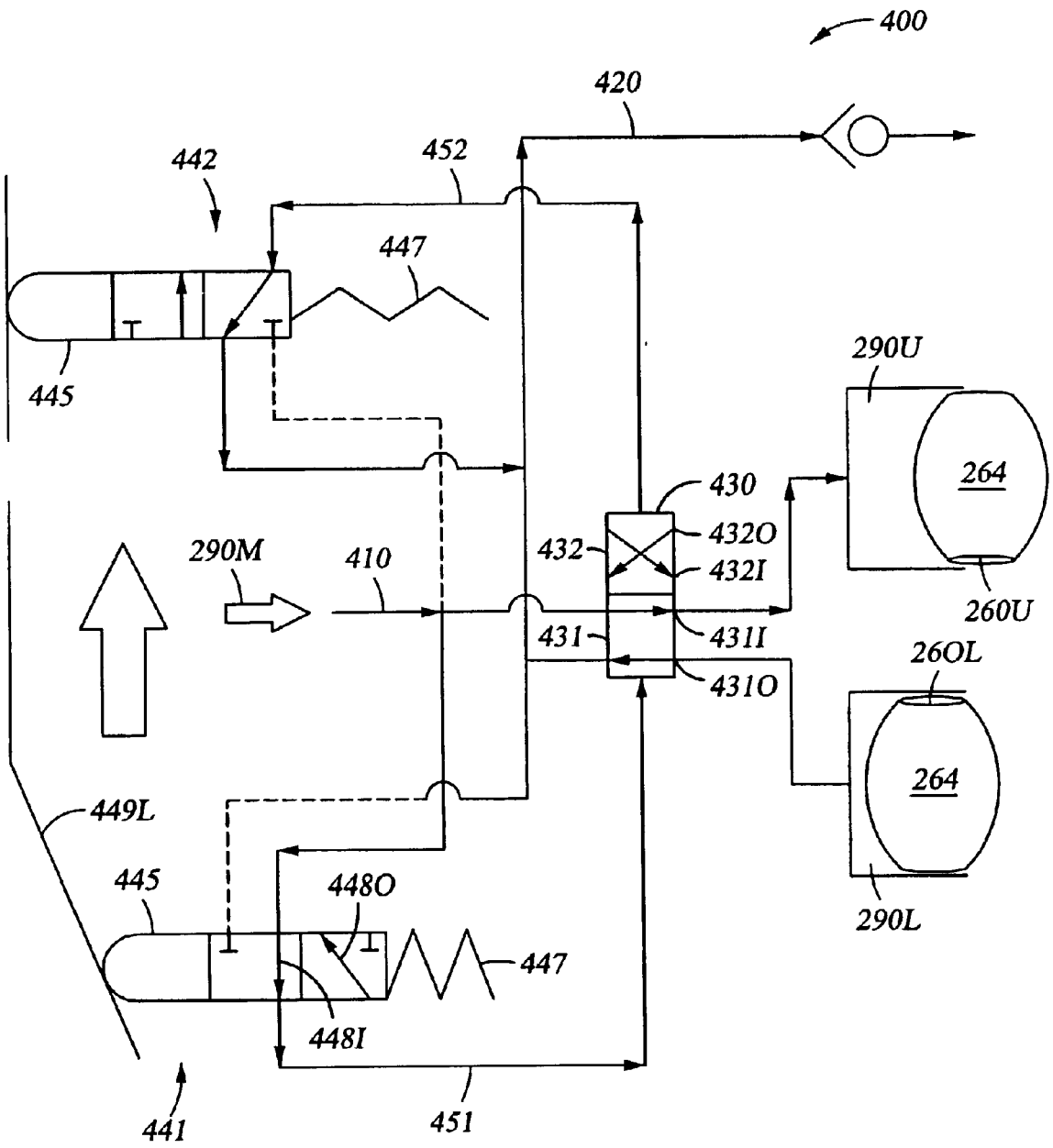
FIGS. 6A—6D are sequential drawings of a network of fluid channels used to direct fluids in the expander tool.

Fluid is directed from the main chamber 290M to the upper chamber 290U or the lower chamber 290L using a network 400 of fluid channels as illustrated in FIG. 6A. Because only one row of rollers 264 is actuated at a time, the network 400 of fluid channels are designed to actuate one row while deactuating the other row. The network 400 of fluid channels include a supply channel 410 for supplying fluid to one chamber to actuate one row of rollers and a bleed channel 420 for bleeding fluid from the other chamber to de-actuate the other row of rollers.

A valve 430 is used to direct fluid flow to the chambers 290U, 290L. The valve 430 comprises two sets of ports 431, 432 and is movable from a first position to a second position. Each set of ports 431, 432 includes an inlet port 431I, 432I to supply fluid to one chamber and an outlet port 431O, 432O to bleed fluid from the other chamber. The valve 430 is designed such that each set of ports 431, 432 is operable with only one position of the valve 430. In the first position shown in FIG. 6A, the first set of ports 431 directs fluid into the upper chamber 290U through the inlet port 431I to actuate the first row 260U of rollers 264. At the same time, fluid is bled from the lower chamber 290L through the outlet port 431O to deactuate the second row 260L of rollers 264. In the second position as shown in FIG. 6C, the second set of ports 432 reverses the flow of fluids to the chambers 290U, 290L. Specifically, the pressurized fluid will now flow into the lower chamber 290L, while fluid in the upper chamber 290U will drain into the bleed channel 420.

One or more shifting mechanisms 441, 442 disposed in the central body are used to control the movement of the valve 430 between the first position and the second position. In FIG. 1, a first shifting mechanism 441 is disposed below seal 281 and a second shifting mechanism 442 is disposed above seal 284. The shifting mechanisms 441, 442 engage a respective profile 449L, 449U formed on the working string 150. In one embodiment, the working string 150 has a first profile 449L formed on an outer surface to engage the first shifting mechanism 441 at the lower limits of the expander tool's 200 axial movement. A second profile 449U is formed on the working string 150 to engage the second shifting mechanism 442 at the upper limits of the expander tool's 200 axial movement.

Figure 7A:
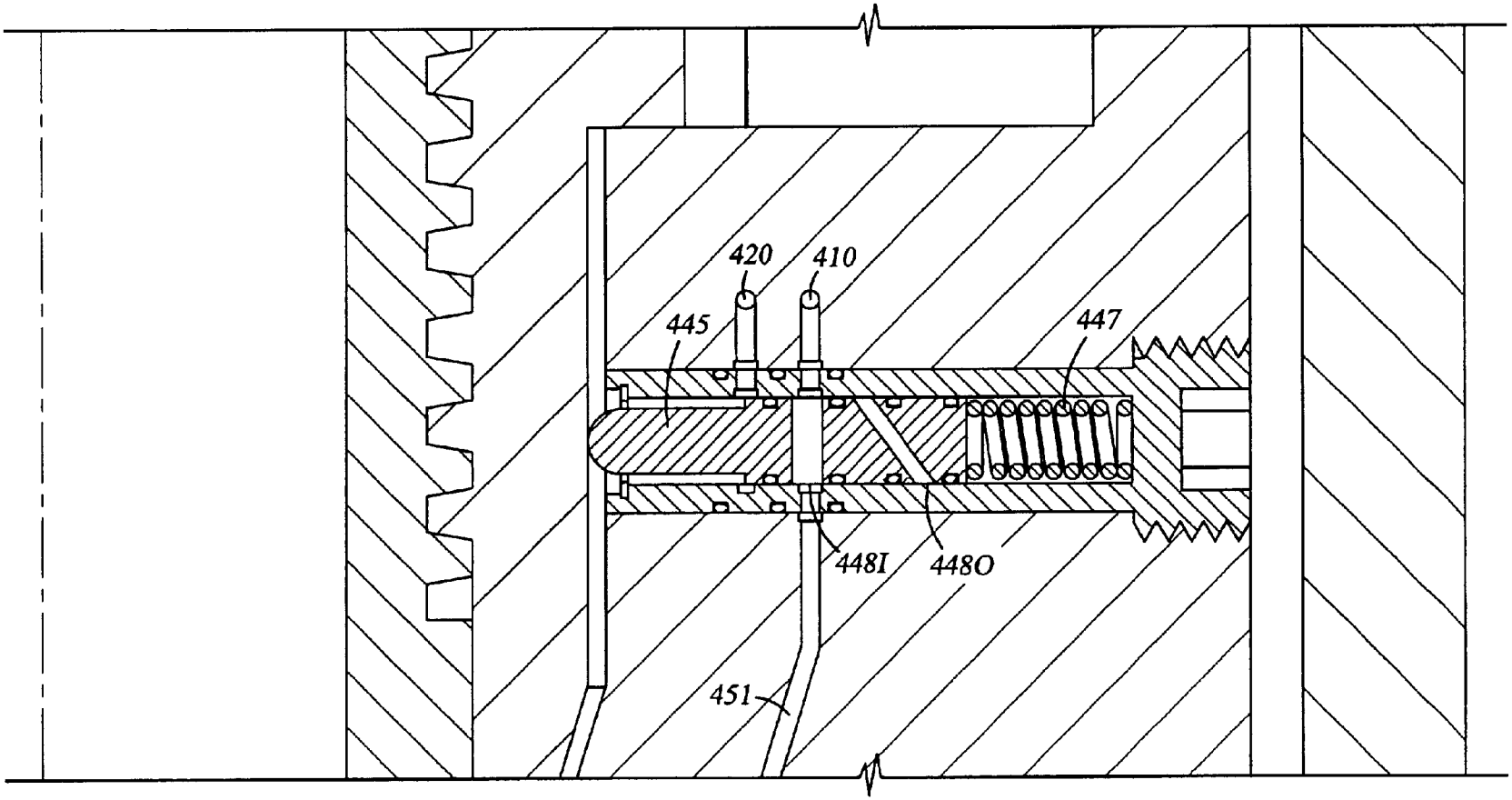
FIG. 7A is a schematic view of an exemplary shifting mechanism in a retracted position.

Each shifting mechanism 441, 442 comprises a rod 445 and a biasing member 447 for biasing the rod 445 against the respective profiles 449U, 449L of the working string 150. The profiles 449U, 449L are designed to shift the rods 445 between an extended position and a retracted position. The rod 445 is in the retracted position when it is biased against the profile 449L. FIG. 7A illustrates an exemplary shifting mechanism in the extracted position. Referring back to FIG. 6A, the rod 445 of the first shifting mechanism 441 is in the retracted position. In this position, fluid from the supply channel 410 flows across an inlet channel 4481 formed in the rod 445 and enters a first valve channel 451 disposed between the rod 445 and the valve 430. The first valve channel 451 delivers the pressurized fluid to the valve 430.

Figure 7B:
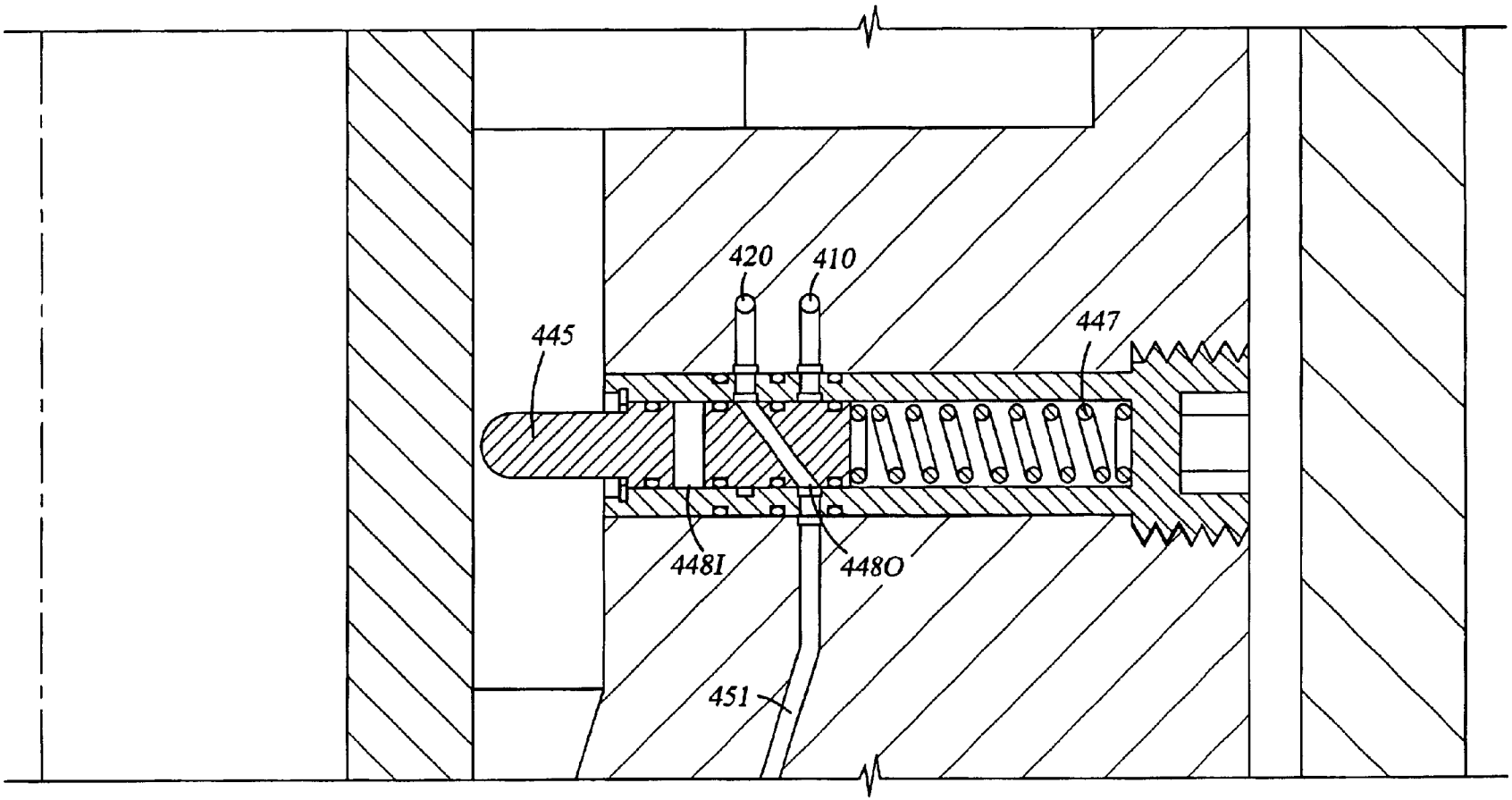
FIG. 7B is a schematic view of an exemplary shifting mechanism in an extended position.

In FIG. 6A, the second shifting mechanism 442 is shown in the extended position. In this position, the supply channel 410 is not in fluid communication with a second valve channel 452 that is disposed between the valve 430 and the second shifting mechanism 442. Instead, an outlet channel 448O in the rod 445 connects the second valve channel 452 to the bleed channel 420. FIG. 7B illustrates an exemplary shifting mechanism in the extended position.

The valve channels 451, 452 are arranged such that each channel 451, 452 may move the valve 430 in an opposite direction of the other channel. In FIG. 6A, the first valve channel 451 is in fluid communication with the supply channel 410 and the second valve channel 452 is open to the bleed channel 420. This setup allows the pressurized fluid in the first valve channel 451 to move the valve 430 from the second position to the first position. When the second shifting mechanism 442 is in the retracted position as illustrated In FIG. 6C, the pressure in the fluid channels 451, 452 are reversed. Specifically, the second valve channel 452 is now in fluid communication with the supply channel 410 and the first valve channel 451 is open to the bleed channel 420. This allows the fluid in the second valve channel 452 to move the valve 430 with minimal resistance from the first valve channel 451. In this manner, the valve 430 may be shifted between the first position and the second position using the first and second shifting mechanisms 441, 442.

In operation, a working string 150 is run into the wellbore to expand an expandable tubular 120 into physical contact with an existing casing 110 in the wellbore. The working string 150 includes a motor 30, a torque anchor 500, an expander tool 200 of the present invention, and a spline assembly 230 coupling the expander tool 200 to the motor 30 as illustrated in FIG. 1. The expander tool 200 is lowered into the wellbore with the expander tool 200 at its lower limits of axial movement. The working string 150 further includes a collett 160 attached near the end of the working string 150 to support the expandable tubular 120. In this manner, the expandable tubular 120 can be introduced into the wellbore at the same time as the expander tool 200.

After the expandable tubular 120 is lowered to the desired depth, pressurized fluid is injected into the working string 150 and travels downhole through the working string 150. Some of the fluids are used to activate the torque anchor 500. The injected fluids are also used to actuate the motor 30, thereby exerting torque on the inner sleeve 231 of the spline assembly 230. The torque is then translated to the outer sleeve 232, and ultimately, to the expander tool 200.

Further, some of the pressurized fluid in the working string 150 delivered to the expander tool 200 through the port 290 in the working string 150. Initial , the fluid enters the main chamber 290M of the annular space 270 formed between the working string 150 and the expander tool 200. The fluid then flows into the supply channel 410 to actuate the rollers 264 as directed by the shifting mechanisms 441, 442 and the valve 430.

FIG. 6A depicts the flow of fluids in the expander tool 200 w en the expander tool 200 is at its lower limits of axial travel. The rod 445 of the first shifting mechanism 441 is biased against the first profile 449L, thereby placing the rod 445 in the retracted position. In this position, the first valve channel 451 is placed in fluid communication with the supply channel 410 through the inlet channel 4481 of the rod 445. Fluid from the supply channel 410 flows into the first valve channel 451, thereby moving the valve 430 to the first position.

On the other hand, the rod 445 of the second shifting mechanism 442 is in the extended position. In this position, the second valve channel 452 is closed off from the supply channel 410, thereby preventing the supply of fluid to the valve 430. Instead, the second valve channel 452 is in fluid communication with the bleed channel 420 through the outlet channel 448O of the rod 445. Thus, any fluid remaining in the second valve channel 452 is allowed to drain away.

With the valve 430 in the first position, the first set of ports 431 is used to direct fluids to and from the upper and lower chambers 290U, 290L. Specifically, the inlet port 431I places the upper chamber 290U in fluid communication with the supply channel 410, and the outlet port 4310 places the lower chamber 290L in fluid communication with the bleed channel 420. Fluid in the supply channel 410 flows through first valve channel 451 to the inlet port 4310 and enter the upper chamber 290U, thereby increasing the pressure in the chamber 290U. The pressurized fluid contacts the back of the piston 268, which, in turn, causes the rollers 264 in the first row 260U to extend radially and contact the inner surface of the expandable tubular 120.

The circulation of fluids to the chamber 290U is regulated at the surface so that the force applied to the inner wall of the expandable tubular 120 is controlled. With a predetermined amount of fluid pressure acting on the piston surface, the expandable tubular 120 is expanded past its elastic limits. Thus, the expandable tubular 120 is expanded by rotating, under pressure, the rollers 264 along the inner wall of the expandable tubular 120.

As the rollers 264 are pressed against the inner wall, the skew angle of the rollers 264 causes the rollers 264 to travel in a spiral along the inner wall. As a result, the expander tool 200 moves axially upward and expands the expandable tubular 120 along a length of the inner wall. Further, as shown in FIG. 2, the outer sleeve 232 moves axially relative to the inner sleeve 231 to accommodate the axial movement of the expander tool 200.

Figure 6B:
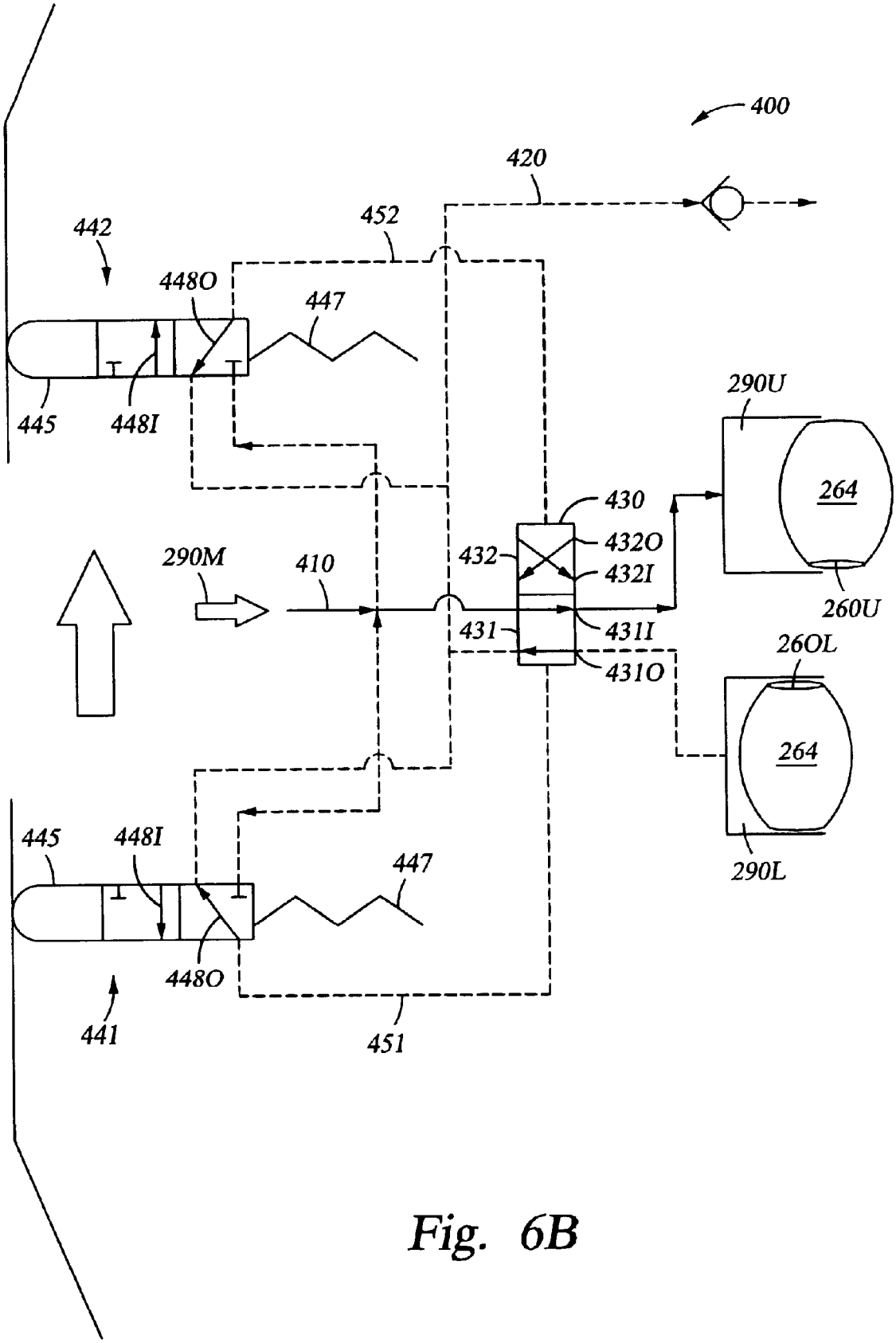
Figure 6C:
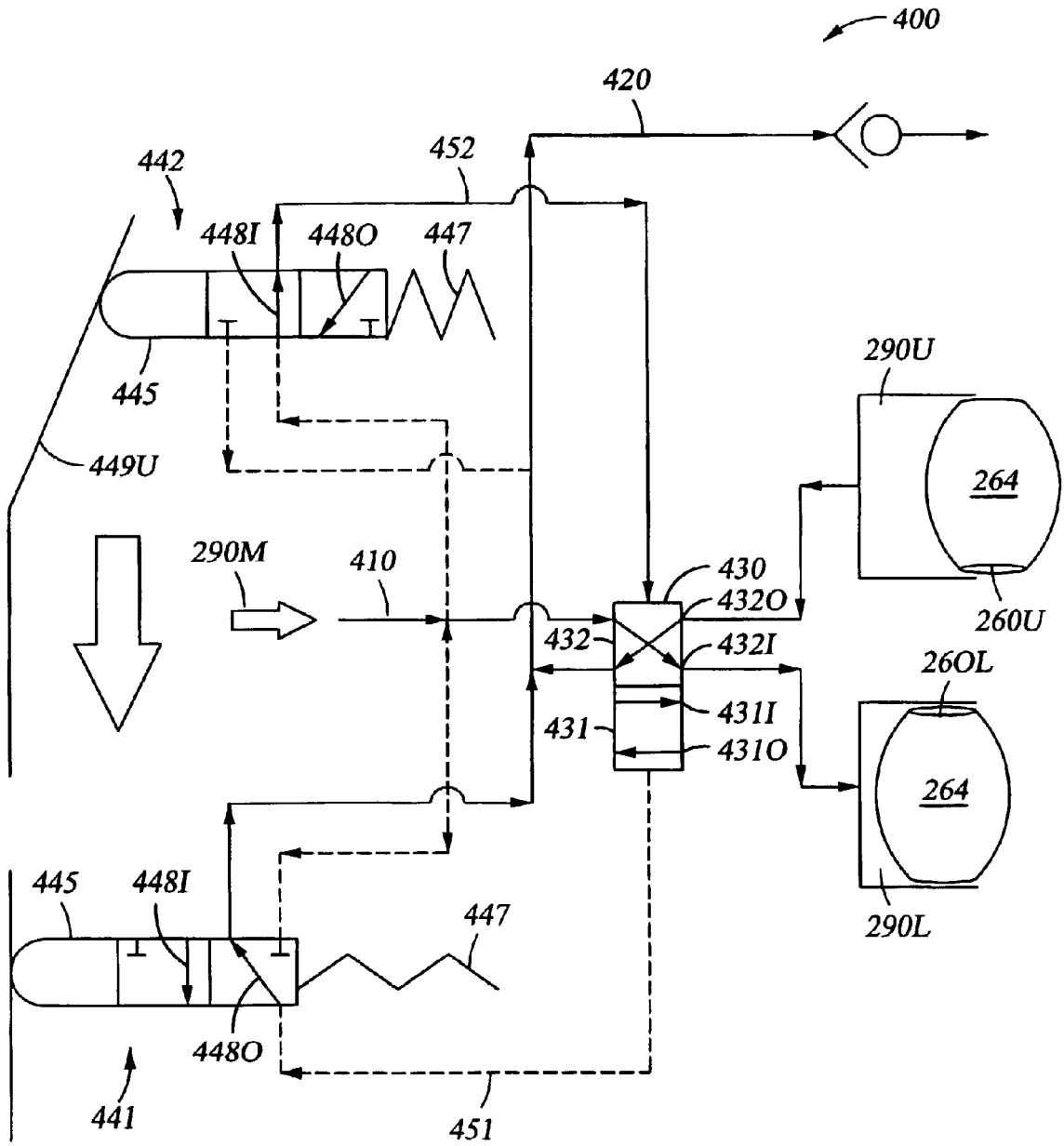

Referring to FIG. 6B, as the expander tool 200 moves away from the first profile 449L, the rod 445 of the first shifting mechanism 441 is extended by the biasing member 447. In this position, the first valve channel 451 is cut off from the supply channel 410 and directed to fluidly communicate with the bleed channel 420. FIG. 6B also shows the second shifting mechanism 442 in the extended position. Because the pressure in the second valve channel 452 does not increase, the valve 430 is able to remain in the first position and maintain the fluid pressure applied to the first row 260U of rollers 264.

As the expander tool 200 moves closer to the upper limits of its axial movement, the rod 445 of the second shifting mechanism 442 begins to encounter the second profile 449U formed on the working string 150. FIG. 6C shows the second shifting mechanism 442 in the retracted position. In this position, the second valve channel 452 is in fluid communication with the supply channel 410. Because the first valve channel 451 is already open to the bleed channel 420, pressurized fluid from the supply channel 410 causes the valve 430 to shift from the first position to the second position. Fluid in the first valve channel 451 is allowed to drain into the bleed channel 420.

With the valve in the second position, the second set of ports 432 in the valve 430 directs the pressurized fluid in the supply channel 410 to the lower chamber 290L. Fluid in the lower chamber 290L contacts the back of the pistons 268 of the second row 260L of rollers 264. As the pressure in the lower chamber 290L builds, the pistons 268 begin to extend the rollers 264 radially into physical contact with the inner wall. Because the upper chamber 290U is closed off from the supply channel 410 and open to the bleed channel 420, the first row 260U of rollers 264 can no longer exert significant pressure on the inner wall. In this manner, the second row 260L of rollers 264 is actuated and the first row 260U of rollers 264 is de-actuated.

Figure 3:
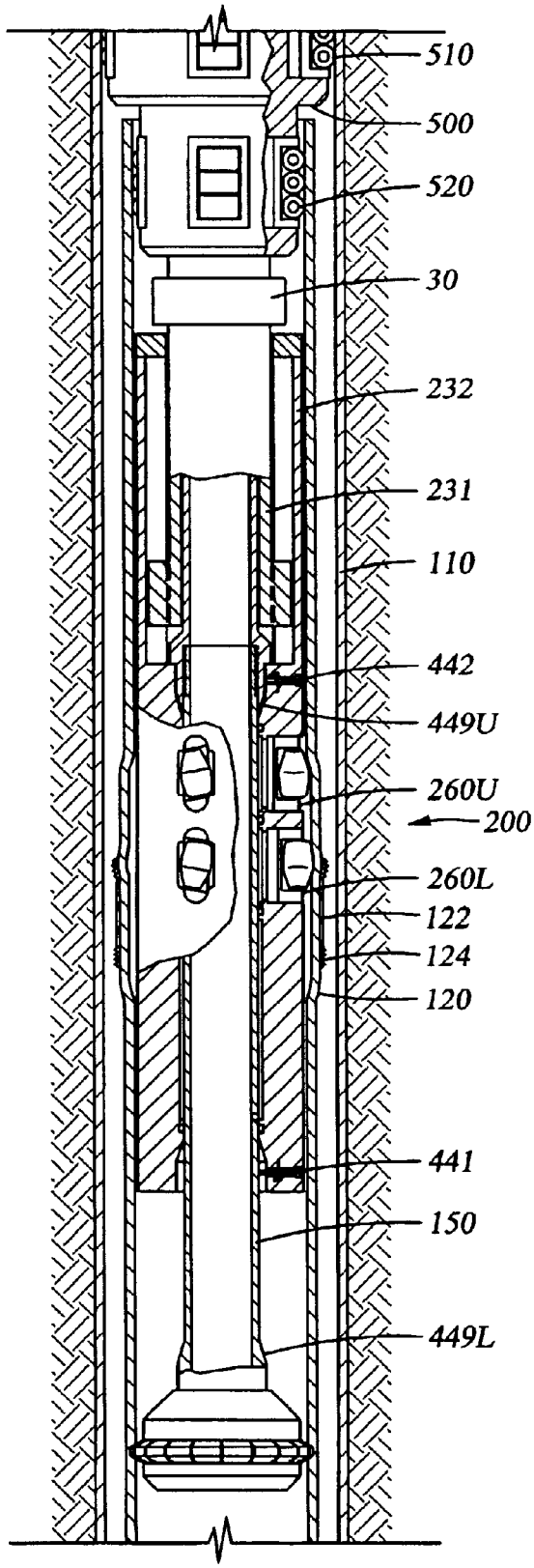
FIG. 3 is a partial sectional view of the expander tool partially translated in the wellbore. In this view, the second row of rollers have engaged the lower string of casing.

Once the second row 260L of rollers 264 is extended into contact with the inner wall, the skew angle of the rollers 264 causes the rollers 264 to move in a spiral. Because the skew angle of the second row 260L of rollers 264 is opposite that of the first row 260U, the expander tool 200 reverses direction and moves downward in the wellbore. During the descent, the expandable tubular 120 is expanded further as illustrated in FIG. 3.

Figure 4:
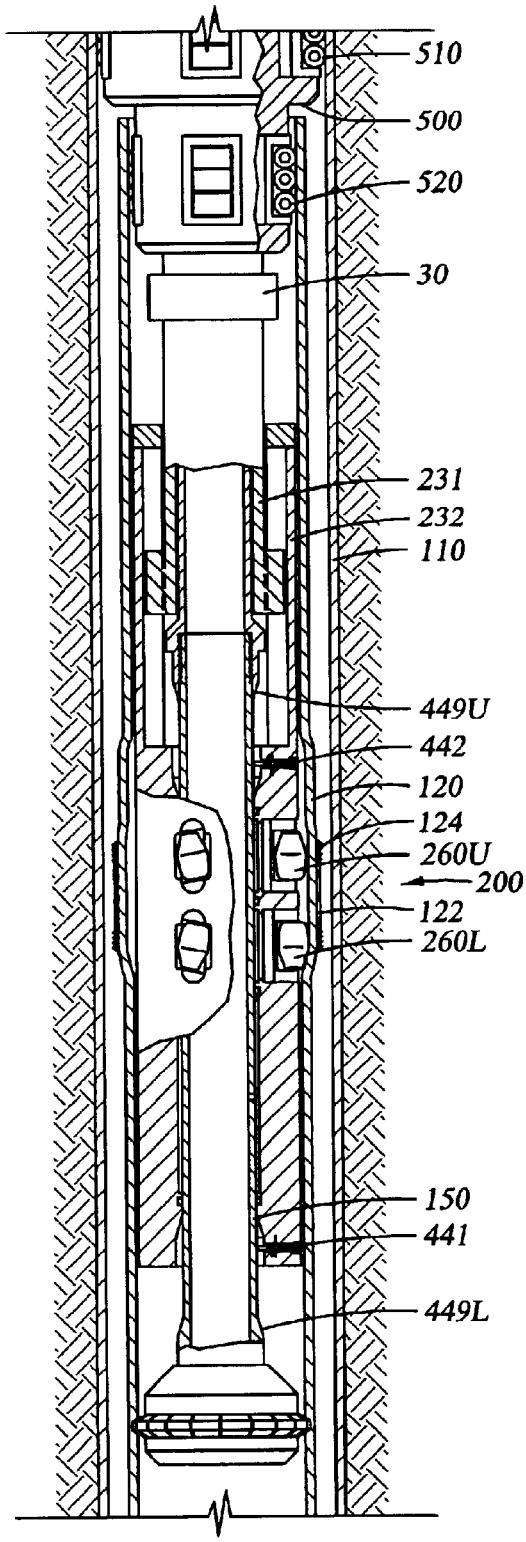
FIG. 4 is a partial sectional view of the expander tool partially translated in the wellbore. In this view, the expander tool is moving downward in the wellbore.
Figure 6D:
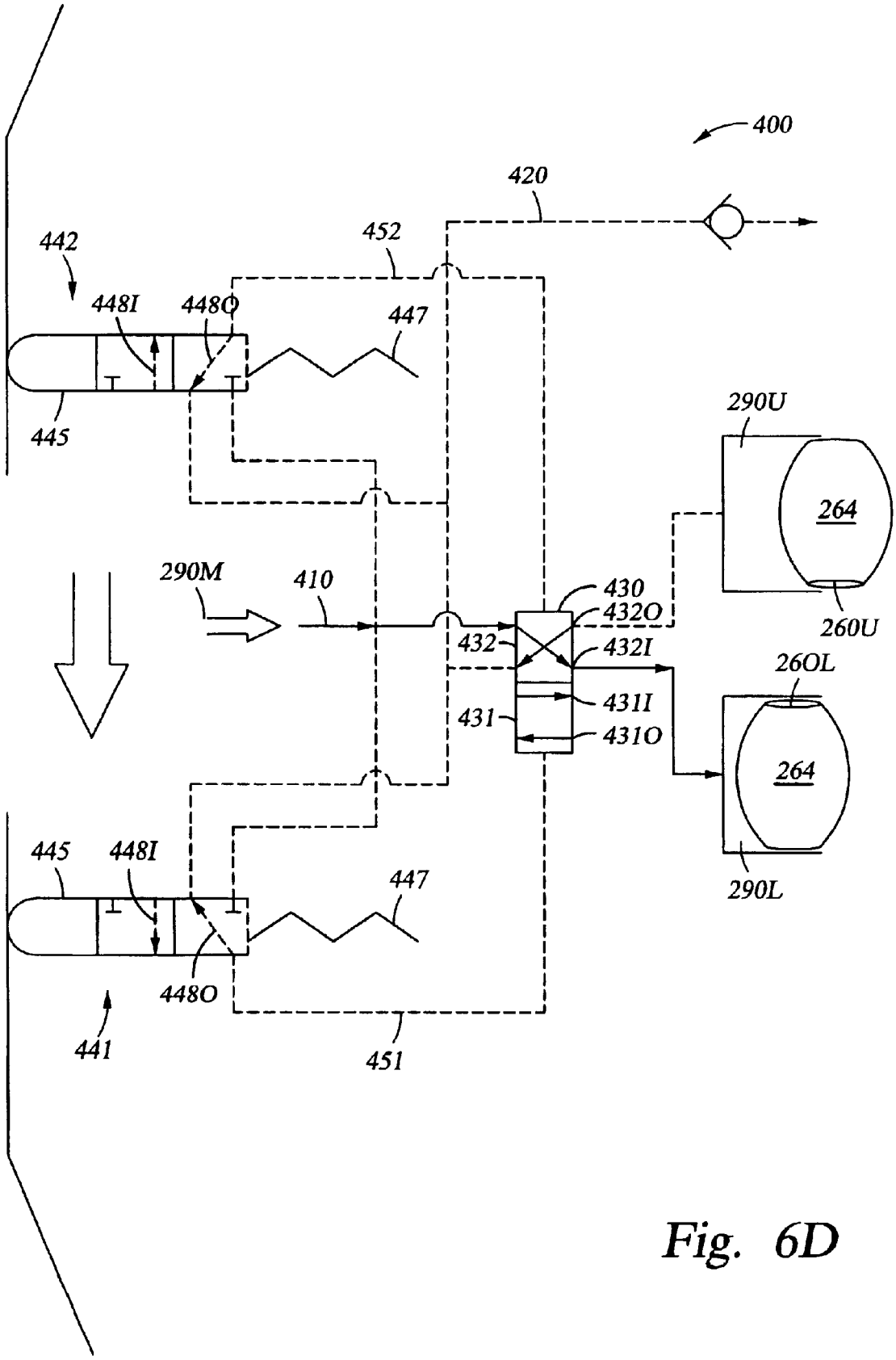

FIG. 4 illustrates the expander tool 200 partially translated in its descent. In this position, the second shifting mechanism 442 has moved away from the second profile 449U. Referring to FIG. 6D, the rod 445 of the second shifting mechanism 442 is extended by the biasing member 447. In this position, the second valve channel 452 is shut off from the supply channel 410 and directed to fluidly communicate with the bleed channel 420. FIG. 6D also shows the first shifting mechanism 441 in the extended position. Because the pressure in the first valve channel 452 does not increase, the valve 430 is able to remain in the second position and maintain the fluid pressure applied to the second row 260L of rollers 264.

Figure 5:
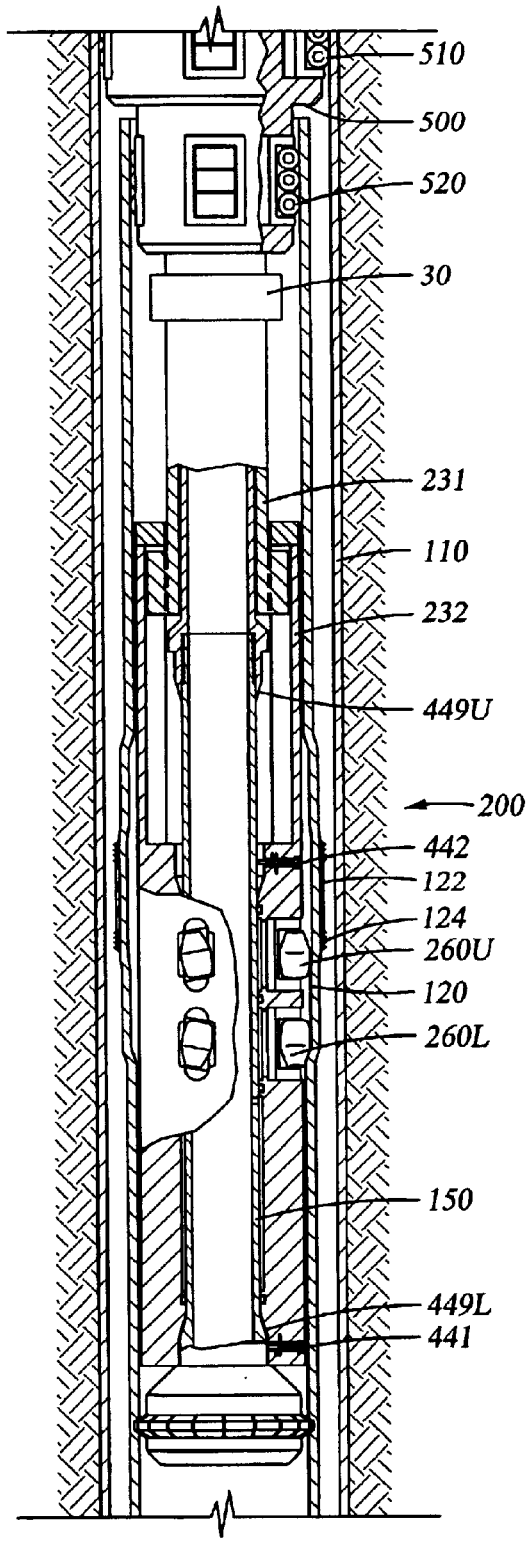
FIG. 5 is a partial sectional view of the expander tool partially translated in the wellbore. In this view, the expander tool is at lower limits of axial movement and the first row of rollers have engaged the lower string of casing.

FIG. 5 illustrates the expander tool 200 at the lower limits of axial travel. As shown, the first row 260U of rollers 264 is actuated and the second row 260L of rollers 264 is de-actuated. The fluid flow is schematically shown in FIG. 6A. In this position, the expander tool 200 is poised to move up the wellbore 100 and continue expanding the tubular 120.

The rows 260U, 260L of rollers 264 are alternately actuated to expand the expandable tubular 120 against the upper string of casing 110. In the process, the expander tool 200 moves up and down in the wellbore in accordance with the row 260U, 260L of rollers 264 actuated. In this manner, the expander tool is able to gradually expand the expandable tubular 120 into physical contact with the outer casing 110.

After expansion, the injection of fluids is stopped and the fluid in the chambers 290U, 290L is allowed to drain into the bleed channel 420 or the supply channel 410. The decrease in pressure in the chambers 290U, 290L causes the rollers 264 to deactuate and return to their respective windows 262. Thereafter, the torque anchor 125 is deactivated and the collett 160 is released. The expander tool 200 may then be retrieved by pulling on the working string 150.

In another embodiment, fluid flow to the chambers 290U, 290L may be controlled by mechanical means. For example, the shifting mechanisms 441, 442 may be designed to mechanically shift the valve 430 between the first and second positions. Specifically, retraction of the rod 445 may be arranged to cause the valve 430 to switch positions. With this design, the supply channel 410 may connect directly to the inlet port 431I, 432I of the valve 430 and the bleed channel 420 may connect directly to the outlet port 431O, 432O of the valve 430.

While the foregoing is directed to embodiments of the present invention, other and further embodiments of the invention may be devised without departing from the basic scope thereof, and the scope thereof is determined by the claims that follow.

What is claimed is:

1. An expander tool for expanding a first tubular against a second tubular, comprising:

a tubular body having a longitudinal axis;

a first row of expander members disposed on the tubular body the first row of expander members positioned at an angle to the longitudinal axis;

a second row of expander members disposed on the tubular body, he second row of expander members positioned at an opposite angle to the first row of roller;

at least two seals; and one or more shifting mechanisms.

2. The expander tool of claim 1, further comprising an extendable housing attached to the tubular body.

3. The expander tool of claim 1, wherein the at least two seals are placed on an inner surface of the tubular body.

4. The expander tool of claim 3, wherein four seals are disposed on the inner surface.

5. The expander tool of claim 1, further comprising a valve.

6. The expander tool of claim 5, wherein the valve is movable between a first position and a second position.

7. The expander tool of claim 6, wherein the one or more shifting mechanisms is movable between a retracted position and an extended position.

8. The expander tool of claim 7, wherein the moving the one or more shifting mechanisms between the retracted position and the extended position causes the valve to move between the first position and the second position.

9. The expander tool of claim 8, wherein the first row of expander members is actuated and the second row of expander members is de-actuated when the valve is in the first position.

10. The expander tool of claim 9, wherein the second row of expander members is actuated and the first row of expander members is de-actuate when the valve is in the second position.

11. The expander tool of claim 10, wherein the expander members comprise rollers.

12. The expander tool of claim 10, wherein each row of expander members comprise three expander members.

13. A method for expanding at least a portion of a first tubular against a second tubular in a wellbore, comprising:

positioning the second tubular in the wellbore;

running the first tubular to a selected depth within the wellbore such that the portion of the first tubular overlaps the second tubular;

expanding the portion of the first tubular using an expander tool comprising:

a first row of expander members positioned at an angle to the longitudinal axis; and a second row of expander members positioned at an opposite angle of the first row; and removing the expander tool.

14. The method of claim 13, wherein expanding the first tubular comprises alternately actuating the first row of expander members and the second row of expander members.

15. The method of claim 14, wherein the actuating the first row of expander members comprises extending the expander members radially to contact the first tubular.

16. The method of claim 13, wherein expanding the first tubular comprises moving the expander tool axially.

17. The method of claim 16, wherein expanding the first tubular further comprises alternately actuating the first row of expander members and the second row of expander members.

18. The method of claim 17, wherein alternately actuating the first row of expander members and the second row of expander members causes the expander tool to change axial directions.

19. An expander apparatus for use in a wellbore, comprising:

a working string;

a torque anchor disposed on the working string;

a downhole motor disposed on the working string;

an expander tool coupled to the working string, the expander tool comprising:

one or more expander members in a first position; and one or more expander members in a second position, wherein the first position and the second position are at opposite angles relative to a longitudinal axis.

20. The expander apparatus of claim 19, further comprising shifting means for alternately actuating the one or more expander members in the first position and the one or more expander members in the second position.

21. The expander apparatus of claim 20, wherein actuating the one or more expander members in the first position causes the expander tool to move in a first axial direction.

22. The expander apparatus of claim 21, wherein actuating the one or more expander members in the second position causes the expander tool to move in a second axial direction.

23. The expander apparatus of claim 22, wherein the expander members are hydraulically actuated.

24. The expander apparatus of claim 19, wherein rotating the downhole motor also rotates the expander tool.

25. The expander apparatus of claim 19, wherein the expander tool is coupled to the motor using a spline assembly.

26. The expander apparatus of claim 25, wherein the spline assembly comprises an inner sleeve at least partially disposed in an outer sleeve.

27. The expander apparatus of claim 26, wherein the inner sleeve is coupled to the outer sleeve using a spline connection.

28. The expander apparatus of claim 25, wherein rotating the downhole motor also rotates the expander tool.

29. The expander apparatus of claim 28, wherein the one or more expander members cause the expander tool to move axially when rotated.

30. An expander assembly comprising:

an expander tool comprising:

one or more expander members, and means for translating the expander tool in both axial direction;

means for anchoring the expander tool; and means for actuating the expander tool, wherein the expander tool is capable of expanding a tubular while translating in both axial directions.

31. The expander assembly of claim 30, wherein means for anchoring the expander tool comprises means for anchoring the expander tool in a wellbore.

32. The expander assembly of claim 30, further comprising a working string coupled to the expander tool.

33. The expander assembly of claim 30, wherein the one more expander members translate the expander tool in both axial directions.

34. An expander tool, comprising:

a tubular body;

one or more first expander members axially spaced from one or more second expander members, the first and second expander members disposed on the body, wherein the first expander members are capable of axially translating the expander tool in a first direction within a tubular and the second expander members are capable of axially translating the expander tool in a second direction within the tubular.

35. The expander tool of claim 34, wherein the one or more first expander members are movable to a first position and the one or more second expander members are alternately movable to a second position.

36. The expander tool of claim 35, further comprising one or more shifting mechanisms for moving the first and second expander members between the first and second positions.

37. The expander tool of claim 36, wherein the one or more shifting mechanisms are moveable between a retracted position and an extendable position.

38. The expander tool of claim 35, wherein the first and second positions are at opposite angles relative to a longitudinal axis of the tubular body.

39. The expander tool of claim 34, wherein the one or more first expander members and the one or more second expander members are rolling members.

40. The expander tool of claim 34, wherein the one or more first expander members are extendable at a first angle to axially translate the expander tool in the first direction.

41. The expander tool of claim 40, Wherein the one or more second expander members are extendable at a second angle substantially opposite the first angle to axially translate the expander tool in the second direction.

42. The expander tool of claim 40, wherein the first angle is adjustable to determine a rate of axial movement of the expander tool.

43. The expander tool of claim 34, wherein the one or more first expander members comprise a first row of expander members and the one or more second expander members comprise a second row of expander members.

44. The expander tool of claim 34, wherein the expander tool is disposed in a wellbore.

45. A method for expanding at least a portion of a first tubular, comprising:

providing a first tubular and an expander tool, the expander tool having one or more first expander members axially spaced from one or more second expander members;

expanding at least the portion of the first tubular by alternately actuating the one or more first expander members and the one or more second expander members.

46. The method of claim 45, wherein alternately actuating the one or more first expander members and the one or more second expander members causes the expander tool to change axial direction.

47. The method of claim 46, wherein actuating the one or more first expander members comprises positioning the first expander members at a first angle with respect to a longitudinal axis of an expander tool body and actuating the one or more first expander members comprises positioning the second expander members at a second angle with respect to the longitudinal axis.

48. The method of claim 47, wherein the first angle is substantially opposite the second angle.

49. The method of claim 46, wherein at least the portion of he first tubular is expanded into a second tubular disposed within a wellbore.

50. The method of claim 49, wherein at least the portion of the first tubular overlaps the second tubular.

51. The method of claim 46, wherein at least the portion of the first tubular is expanded into contact with a surrounding wellbore.

52. The method of claim 45, wherein alternately actuating the one or more first expander members and the one or more second expander members comprises alternately extending and retracting the first and second expander members.

53. The method of claim 45, wherein expanding at least a portion of the first tubular comprises rotating the expander tool relative to the first tubular.

54. The method of claim 45, wherein expanding at least the portion of the first tubular comprises axially moving the expander tool relative to the first tubular.

55. The method of claim 45, wherein alternately actuating the one or more first expander members and the one or more second expander members comprises:

actuating the one or more first expander members to translate the expander tool in a first axial direction; and alternately actuating the one or more second expander member to translate the expander tool in a second axial direction.

56. The method of claim 45, further comprising adjusting an angle of the one or more first expander members when actuated to alter a rate of expansion of the first tubular.

57. The method of claim 45, further comprising adjusting an angle of the one or more first expander members when actuated to alter a rate of movement of the expander tool.

58. The method of claim 45, wherein the expander tool is disposed within the first tubular at an initial location prior to expanding at least the portion of the first tubular, the initial location between a first end and a second end of the first tubular.

59. The method of claim 58, wherein at least the portion of the first tubular comprises a first portion above the initial location and a second portion below the initial location.

* * * * *